US011781735B2

(12) United States Patent
Terumichi

(10) Patent No.: US 11,781,735 B2
(45) Date of Patent: Oct. 10, 2023

(54) LIGHTING UNIT BODY

(71) Applicant: MODULEX INC., Tokyo (JP)

(72) Inventor: Goro Terumichi, Tokyo (JP)

(73) Assignee: MODULEX INC., Tokyo (JP)

( * ) Notice: Subject to any disclaimer, the term of this patent is extended or adjusted under 35 U.S.C. 154(b) by 0 days.

(21) Appl. No.: 17/614,395

(22) PCT Filed: Jun. 2, 2020

(86) PCT No.: PCT/JP2020/021847
§ 371 (c)(1),
(2) Date: Nov. 26, 2021

(87) PCT Pub. No.: WO2020/246486
PCT Pub. Date: Dec. 10, 2020

(65) Prior Publication Data

US 2022/0228725 A1 Jul. 21, 2022

(30) Foreign Application Priority Data

Jun. 3, 2019 (JP) ..... 2019-104049

(51) Int. Cl.
*F21V 7/00* (2006.01)
*F21S 4/28* (2016.01)
*F21V 7/08* (2006.01)

(52) U.S. Cl.
CPC ..... *F21V 7/0008* (2013.01); *F21S 4/28* (2016.01); *F21V 7/08* (2013.01)

(58) Field of Classification Search
CPC .. F21V 7/0008; F21V 7/08; F21V 7/09; F21S 4/28; F21S 8/033; F21S 8/04; F21Y 2103/10; F21Y 2115/10
See application file for complete search history.

(56) References Cited

U.S. PATENT DOCUMENTS 5,709,460 A 1/1998 Lester
8,038,327 B1 * 10/2011 Franck ..... F21V 3/049 362/249.02

(Continued)

FOREIGN PATENT DOCUMENTS

JP 2002-216518 A 8/2002
JP 2010-067410 A 3/2010
JP 6425436 B2 11/2018

OTHER PUBLICATIONS

The extended European search report (EESR) dated May 24, 2023 in a counterpart European patent application.

*Primary Examiner* — Tsion Tumebo
(74) *Attorney, Agent, or Firm* — METROLEX IP LAW GROUP, PLLC

(57) ABSTRACT

A lighting unit body comprises: a light source; and shaped-members, in which a housing portion in which the light source is disposed, reflective surfaces for reflecting light from the light source, and an emission outlet for emitting the light from the reflective surfaces are respectively formed in the longitudinal direction. When a position at which the emission outlet is disposed is defined as forward and a direction orthogonal to the longitudinal direction is defined as a front-to-rear direction, and a direction orthogonal both to the longitudinal direction and the front-to-rear direction is defined as a left-to-right direction, then the emission outlet is formed in a front portion of the reflective surfaces, and the housing portion is formed in a rear portion of the reflective surfaces directed obliquely rearward at a predefined inclined angle on one of left or right side. The predefined inclined angle is an angle that inhibits visual observation of the light source from the front of the emission outlet, and the left-to-right direction position at which the light source is disposed is included in the left-to-right direction position at which the emission outlet is located.

6 Claims, 7 Drawing Sheets

(56) References Cited

U.S. PATENT DOCUMENTS

| | | | | |
|---|---|---|---|---|
| 8,197,105 | B2 * | 6/2012 | Yang | F21S 8/033 362/217.05 |
| 8,562,168 | B2 * | 10/2013 | Napoli | F21V 21/02 362/147 |
| 9,726,337 | B2 * | 8/2017 | Hedberg, Jr. | F21S 8/026 |
| 2006/0120078 | A1 * | 6/2006 | Klose | F21S 8/026 362/240 |
| 2008/0204888 | A1 | 8/2008 | Kan et al. | |
| 2011/0058353 | A1 * | 3/2011 | Yang | F21S 4/28 362/231 |
| 2012/0099300 | A1 * | 4/2012 | Napoli | F21S 8/033 362/147 |
| 2012/0218757 | A1 * | 8/2012 | Gill | F21V 15/015 362/249.02 |
| 2013/0235589 | A1 | 9/2013 | Ohno et al. | |
| 2013/0294053 | A1 * | 11/2013 | Marquardt | F21V 17/10 29/832 |
| 2015/0241023 | A1 * | 8/2015 | Kim | F21V 23/023 362/296.05 |
| 2016/0273745 | A1 * | 9/2016 | Lee | F21V 21/08 |
| 2017/0153498 | A1 * | 6/2017 | Qiu | G02F 1/133608 |
| 2019/0086041 | A1 | 3/2019 | Lin et al. | |
| 2019/0162402 | A1 * | 5/2019 | Ji | F21V 33/0044 |

* cited by examiner

LIGHTING UNIT BODY

TECHNICAL FIELD

The present invention relates to a lighting unit body for a lighting unit, wherein the lighting unit body can provide indirect lighting without changing interior fixtures.

BACKGROUND

A lighting unit body that can provide indirect lighting without changing interior fixtures is proposed in Patent Document 1.

Patent Document 1 describes the lighting unit body in [Solution] in [Abstract] at the time of filing the application, as follows.

"As illustrated in FIG. 1, a reflective shaped-member 1 comprises a lighting unit 2, and a shaped-member 3 to which the lighting unit 2 is mounted. The shaped-member 3 comprises a reflective surface 30 for reflecting radiation of the lighting unit, and emits light from the reflective surface 30. The shaped-member 3 is made of an aluminum shaped-member. With the reflective surface 30, soft shiny light can be generated, and soft lighting performance can be achieved using the shaped-member as an optical means."

In addition, Patent Document 1 indicates in claim 1 at the time of issuance, as follows:

"A shaped-member comprises a reflective LED comprising: a lighting unit comprising an LED plate as a light emitting means; and a shaped-member to which the lighting unit is mounted, wherein the shaped-member comprises a reflective surface for reflecting light radiated from the lighting unit, and shapes light to be emitted from the reflective surface, wherein the reflective surface comprises an inclined surface located on one end side of the shaped-member and inclined with respect to an irradiation surface of the lighting unit, a flat surface formed substantially in parallel to the irradiation surface, and a surface extending from the flat surface to the other end side of the shaped-member and being not in parallel to the flat surface."

PRIOR ART DOCUMENT

Patent Document

PATENT DOCUMENT 1: Japanese Patent number JP-B-6, 425,436

SUMMARY OF THE INVENTION

Problems to be Solved by the Invention

However, according to Patent Document 1, when a direction from left to right in FIG. 2A is defined as a left-to-right direction, there has been a problem in that the left-to-right direction width of the reflective shaped-member 1 tends to be wide.

In other words, light is reflected by the reflective surface 30 that is composed of an inclined surface 300, a flat surface 301, and a bent surface 302, and then emitted from "an emission outlet" formed on the right side of an irradiation surface 24. Therefore, the left-to-right direction width of the reflective shaped-member 1 is "the left-to-right direction width of the irradiation surface 24 plus the left-to-right direction width of the emission outlet plus a", which tends to become wide.

The present invention has been made in view of the circumstances described above, and an object of the present invention is to provide a lighting unit body that can provide indirect lighting without changing interior fixtures, wherein the left-to-right direction width of the lighting unit body can be reduced.

Means for Solving the Problems

To achieve the object described above, a lighting unit body according to the present invention comprises: a light source; and a shaped-member, in which a housing portion in which the light source is disposed, a reflective surface for reflecting light that comes from the light source, and an emission outlet for emitting the light that comes from the reflective surface are respectively formed in a longitudinal direction. The lighting unit body is characterized in that, when a position at which the emission outlet is located is defined as forward and a direction orthogonal to the longitudinal direction is defined as a front-to-rear direction and when a direction orthogonal both to the longitudinal direction and the front-to-rear direction is defined as a left-to-right direction, then the emission outlet is formed in a front portion of the reflective surface, and the housing portion is formed in a rear portion of the reflective surface and directed obliquely rearward at a predefined inclined angle on one of either left or right side, and the predefined inclined angle is an angle that inhibits visual observation of the light source from the front of the emission outlet, and wherein the left-to-right direction position at which the light source is disposed is included in the left-to-right direction position at which the emission outlet is located.

Effect of the Invention

According to the present invention, in the lighting unit body, the housing portion, in which the light source is disposed, is formed in a rear portion of the reflective surface, and directed obliquely rearward at a predefined inclined angle on one of either left or right side. The predefined inclined angle is an angle that inhibits visual observation of the light source from the front of the emission outlet, and thus indirect lighting can be provided without changing interior fixtures. In addition, in the lighting unit body, the left-to-right direction position at which the light source is disposed is included in the left-to-right direction position at which the emission outlet is located, and thus "the left-to-right direction width of the light source plus the left-to-right direction width of the emission outlet" does not exceed "the left-to-right width of the emission outlet." Therefore, the left-to-right direction width of the lighting unit body can be reduced accordingly.

EMBODIMENTS FOR IMPLEMENTING THE INVENTION

Figure 1:
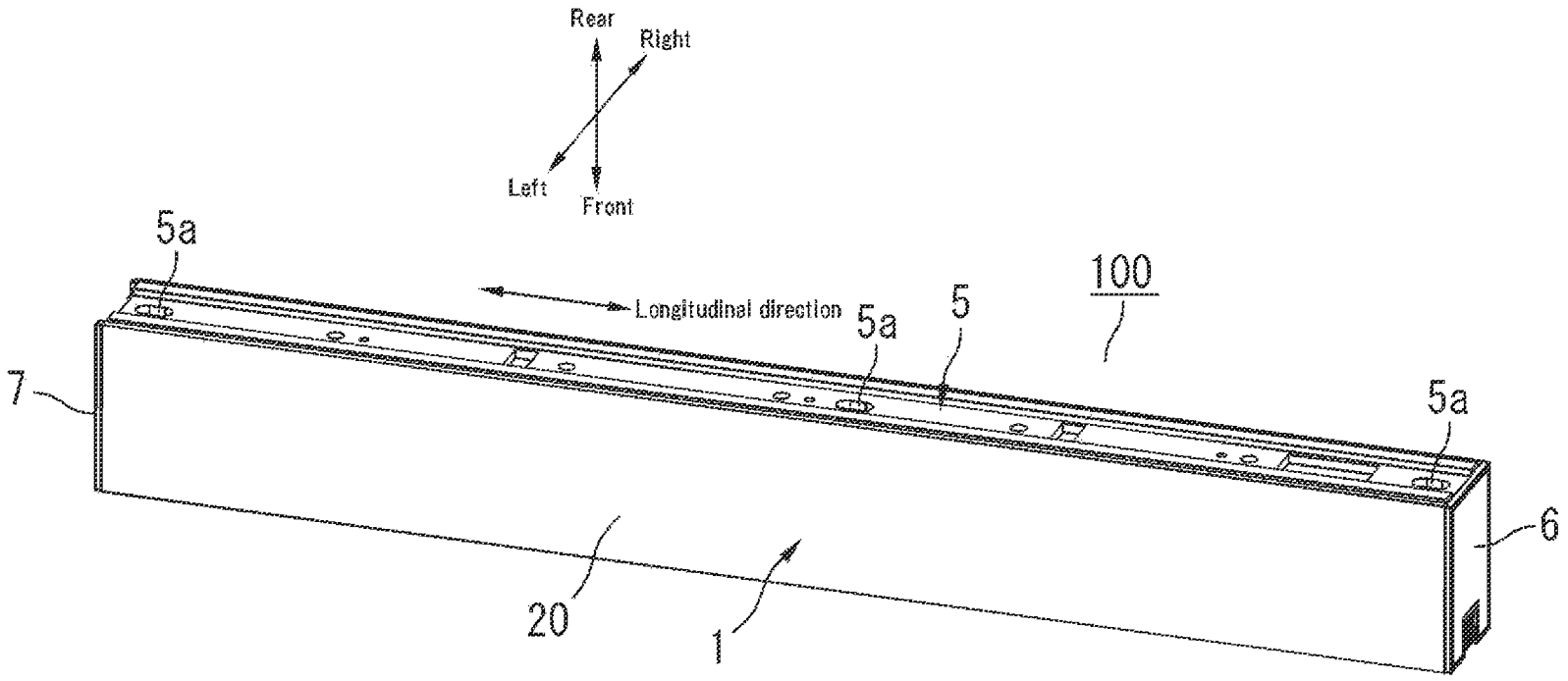
FIG. 1 is an oblique view of a lighting unit 100.

Embodiments, to which the present invention is applied, are described below in detail with reference to drawings. In the drawings, members designated by the same reference numerals are of the same or a similar configuration, and thus duplicate explanation thereof is omitted. In addition, in the drawings, members that are not necessary for explanation are omitted as appropriate.

First Embodiment

The lighting unit body 1 according to the first embodiment, to which the present invention is applied, is described with reference to FIG. 1, FIG. 2, and FIG. 5.

FIG. 1 is an oblique view of the lighting unit 100. FIG. 2 is a view schematically illustrating a cross section orthogonal to the longitudinal direction of the lighting unit body 1 of the first embodiment. FIG. 5 is a light path diagram of the lighting unit body 1 illustrated in FIG. 2.

In the description below, as illustrated by allows in FIG. 1, a direction along the lighting unit 100 is defined as a longitudinal direction, and one of directions that are orthogonal to the longitudinal direction is defined as a front-to-rear direction (Note that a portion in which an emission outlet 13 is located is defined as front, and opposite side thereof is defined as rear.), and a direction orthogonal both to the longitudinal direction and to the front-to-rear direction is defined as a left-to-right direction. In addition, front, rear, left, and right illustrated by arrows in FIG. 2 respectively correspond to front, rear, left, and right of the lighting unit body 1.

As illustrated in FIG. 1, the lighting unit 100 comprises the lighting unit body 1 being long in the longitudinal direction, a securing plate 5 disposed at a rear end of the lighting unit body 1, and decorative covers 6, 7 or the like respectively disposed at both ends in the longitudinal direction.

Figure 2:
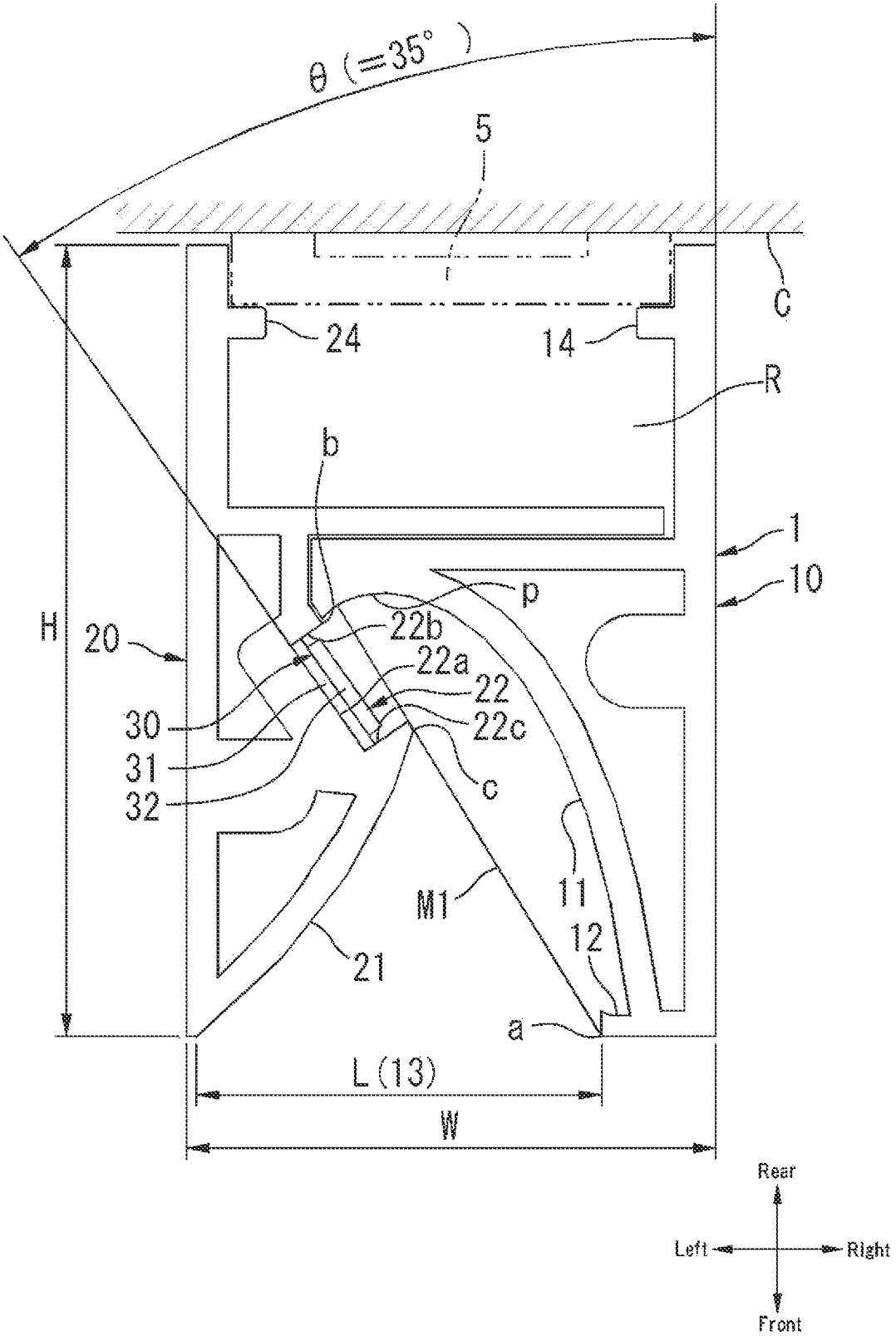
FIG. 2 is a view schematically illustrating a cross section orthogonal to a longitudinal direction of a lighting unit body 1 of a first embodiment.

The lighting unit body 1 comprises shaped-members 10, 20 and a light source 30, as illustrated in FIG. 2.

The shaped-member 10, 20 are formed to be long in the longitudinal direction, for example by a drawing processing of an aluminum member. The shaped-members 10, 20 are joined each other with bolts or the like (not shown) to form a rectangular shape whose front-to-rear direction length H is greater than the left-to-right direction width W. In the example illustrated in FIG. 2, the left-to-right direction width W is set to be 1 inch (25.4 mm) or less.

The shaped-member 10 has a first reflective surface 11. The shaped-member 20 has a second reflective surface 21 and a housing portion 22. The emission outlet 13 is formed in a front portion of the first reflective surface 11 and the second reflective surface 21. In addition, the housing portion 22 is formed in a rear portion of the second reflective surface 21.

The housing portion 22 is formed in the rear portion of the second reflective surface 21, and directed obliquely rearward at a predefined inclined angle θ on one of either left or right side (In the example illustrated in FIG. 2, right obliquely rearward). In addition, the housing portion 22 is formed into a concave shape, and has a bottom surface 22*a* on which the light source 30 described below is to be disposed, a rear side surface 22*b* located rearward thereof, and a front side surface 22*c* located forward thereof. The predefined inclined angle θ of the housing portion 22 is equal to a predefined inclined angle θ of the bottom surface 22*a*, and both are θ. In the example illustrated in FIG. 2, the predefined inclined angle θ with respect to the front-to-rear direction is set as θ=35°, for example.

The first reflective surface 11 is formed into a concave shape. The first reflective surface 11 is formed such that it initially extends substantially orthogonally from the vicinity of a tip b of the rear side surface 22*b* to the bottom surface 22*a*, and reaches an end point p (a point located at the rearmost position), and is then gradually directed forward to extend to one end of the emission outlet 13 (right end, in the example illustrated in FIG. 2).

The second reflective surface 21 is formed into a convex shape. The second reflective surface 21 is formed such that it initially extends from the vicinity of a tip c of the front side surface 22*c* to the other end of the emission outlet 13 (left end, in the example illustrated in FIG. 2).

The first reflective surface 11 and the second reflective surface 21 described above face each other. The spacing between the two surfaces in the left-to-right direction is wider at a front portion than at a rear portion.

At the emission outlet 13, a protrusion 12 extends outward from the first reflective surface 11 toward the second reflective surface 21. The left-to-right direction width L of the emission outlet 13 is thus reduced by the height of the protrusion 12.

The light source 30 comprises a substrate 31 being long in the longitudinal direction, and evenly spaced LEDs (light emitting diodes) 32 disposed on the substrate 31. The light source 30 is disposed at a position nearer to the bottom surface 22*a* than a straight line M1 connecting a tip a of the protrusion 12 and the tip c of the front side surface 22*c*.

The first reflective surface 11 described above is formed in one component (shaped-member 10), which is one of a plurality of components that make up a shaped-member, and the second reflective surface 21 is formed in another one component (shaped-member 20). As a result, no joint is be formed between the first reflective surface 11 and the second reflective surface 21, and thus reflection light becomes smoother accordingly.

The lighting unit body 1 described above may be mounted onto a ceiling C, for example, through the securing plate 5.

As illustrated in FIG. 1, a total of three ellipse holes 5*a* are provided in the securing plate 5: one in the vicinity of the decorative cover 6, one in the vicinity of the decorative cover 7, and one at an intermediate portion between them. The securing plate 5 can be mounted onto the ceiling C, using screws (not shown) inserted through the holes from under the securing plate.

Protruding portions 14, 24 respectively protruding inward from a respective upper portion of the shaped-members 10, 20 are then fitted to the securing plate 5, thereby the lighting unit body 1 is positioned in place.

The lighting unit body 1 is then mounted to the securing plate 5, by means of an anti-drop tool (not shown) provided in a housing room R.

As described above, the lighting unit body 1 can be mounted onto the ceiling C.

The lighting unit body 1 may be mounted onto a wall surface Wa, instead of onto the ceiling C, with its longitudinal direction being directed vertically, or with its longitudinal direction being directed horizontally.

Figure 5:
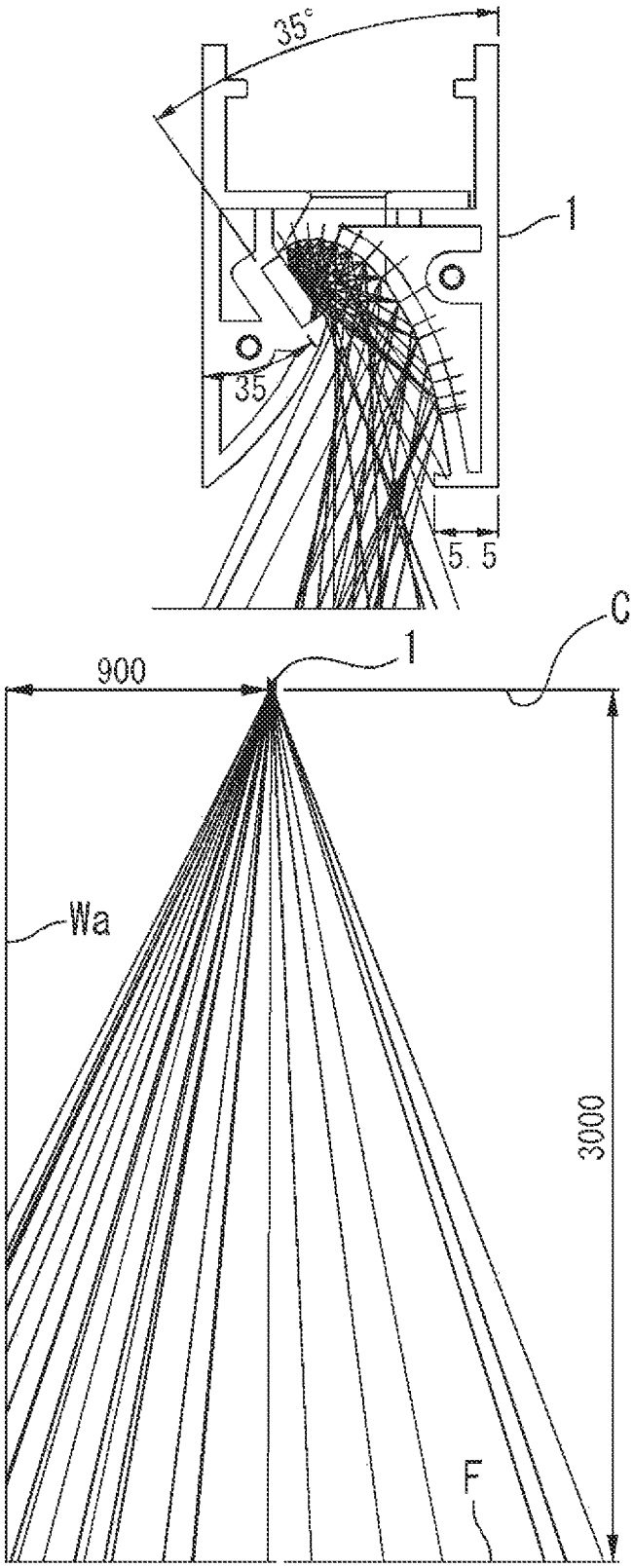
FIG. 5 is a light path diagram of the lighting unit body 1 illustrated in FIG. 2.

FIG. 5 illustrates light paths when the lighting unit body 1 illustrated in FIG. 2 is mounted onto a ceiling C with a height of 3000 mm from a floor surface F, and spaced 900 mm apart from a wall surface Wa.

According to the lighting unit body 1, the floor surface F and a lower portion of the wall surface Wa can be illuminated with indirect light, as illustrated in FIG. 5.

Effects and advantages of the lighting unit body 1 of the first embodiment are summarized below.

In the lighting unit body 1, the emission outlet 13 is formed in the front portion of the first reflective surface 11 and the second reflective surface. In addition, the housing portion 22 is formed in the rear portion of the first reflective surface 11 and the second reflective surface 21, directed obliquely rearward at a predefined inclined angle θ on one of either left or right side. The predefined inclined angle θ is set to be an angle such that it inhibits visual observation of the light source 30 from the front of the emission outlet 13, and the left-to-right direction position at which the light source 30 is disposed is included in the left-to-right direction position at which the emission outlet 13 is located.

With this configuration, the lighting unit body 1 can provide indirect lighting without changing interior fixtures. In addition, in the lighting unit body 1, the left-to-right direction position at which the light source 30 is disposed is included in the left-to-right direction position at which the emission outlet 13 is located, and thus "the left-to-right direction width of the light source 30 plus the left-to-right direction width of the emission outlet 13" does not exceed "the left-to-right direction width L of the emission outlet 13", and thus the left-to-right direction width W of the lighting unit body 1 can be reduced accordingly.

In the lighting unit body 1, direct light that comes from the light source 30 is not emitted from the emission outlet 13. Only indirect light that comes from the light source 30 and that is then reflected by the reflective surfaces (the first reflective surface 11, the second reflective surface 21) is emitted from the emission outlet 13. As a result, a user will not be dazzled by direct light from the light source 30.

In the lighting unit body 1, the housing portion 22 is formed into a concave shape, having the bottom surface 22*a* with a predefined inclined angle 8, the rear side surface 22*b*, and the front side surface 22*c*. The reflective surface has a concave first reflective surface 11 and a convex second reflective surface 21. The first reflective surface 11 and the second reflective surface 21 face each other, and the distance between these surfaces in the left-to-right direction is greater in a front portion than in a rear portion. Therefore, for example, when the lighting unit body 1 is mounted onto the ceiling C, the floor surface F and the wall surface Wa can be illuminated.

When the predefined inclined angle θ with reference to the front-to-rear direction is set to be $5° \leq \theta \leq 45°$, the lighting unit body 1 can illuminate both of the floor surface F and the wall surface Wa, although the illuminated region varies depending on the magnitude of the predefined inclined angle θ.

In the lighting unit body 1, the protrusion 12 is formed at the emission outlet 13, and thus the left-to-right direction width L of the emission outlet 13 is reduced by the height of the protrusion 12. As a result, the light source 30 becomes less visible from the front of the emission outlet 13 accordingly.

In the lighting unit body 1, the light source 30 is disposed nearer to the bottom surface 22*a* than the line M1 connecting the tip a of the protrusion 12 and the tip c of the front side surface 22*c*. Therefore, the light source 30 is not visible from the front of the emission outlet 13.

In the lighting unit body 1, the first reflective surface 11 is formed in one component (shaped-member 10) which is one of a plurality of components that make up a shaped-member, and the second reflective surface 21 is formed in another one component (shaped-member 20). As a result, no joint exists between the first reflective surface 11 and the second reflective surface 21, and thus reflection light becomes smoother.

Second Embodiment

The lighting unit body 2 according to the second embodiment, to which the present invention is applied, is described with reference to FIG. 3 and FIG. 6.

Figure 3:
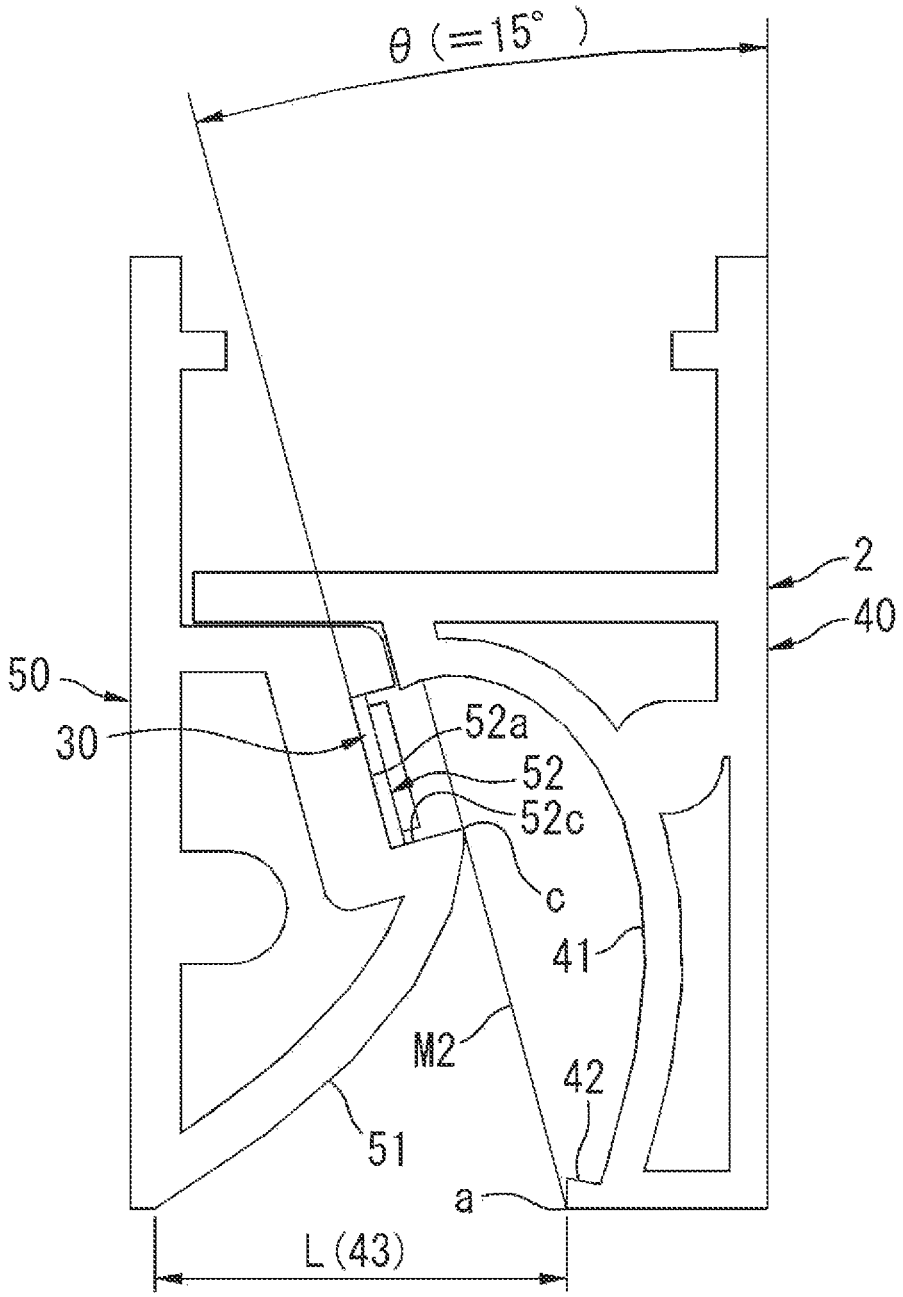
FIG. 3 is a schematic diagram illustrating a cross section orthogonal to a longitudinal direction of a lighting unit body 2 of a second embodiment.

FIG. 3 is a schematic diagram illustrating a cross section orthogonal to the longitudinal direction of the lighting unit body 2 of the second embodiment. FIG. 6 is a light path diagram of the lighting unit body 2 illustrated in FIG. 3.

Note that how the lighting unit body 2 is mounted onto a ceiling C or wall surface Wa is similar to those described for the lighting unit body 1 of the first embodiment. In addition, in the discussion below, differences between the lighting unit body 2 illustrated in FIG. 3 and the lighting unit body 1 illustrated in FIG. 2 are mainly described.

The lighting unit body 2 comprises shaped-members 40 and 50 and a light source 30, as illustrated in FIG. 3.

The shaped-member 40 has a concave first reflective surface 41, and a protrusion 42 is formed at an emission outlet 43.

The shaped-member 50 has a second reflective surface 51 and a housing portion 52. A predefined inclined angle θ of the housing portion 52 is equal to a predefined inclined angle θ of a bottom surface 52*a*, and set to be θ=15°. In other words, in the first embodiment, the predefined inclined angle θ was set to be θ=35°, whereas θ=15° in the second embodiment. Based on this difference, the first reflective surface 41 and the second reflective surface 51 have shapes different from those in the first embodiment.

The light source 30 is the same as that of the lighting unit body 1, but it has a different predefined inclined angle θ.

Also in the second embodiment, the light source 30 is disposed nearer to the bottom surface 52*a* than a straight line M2 connecting a tip a of the protrusion 42 and a tip c of the front side surface 52*c*. Therefore, the light source 30 is not visible from the front of the emission outlet 43.

Figure 6:
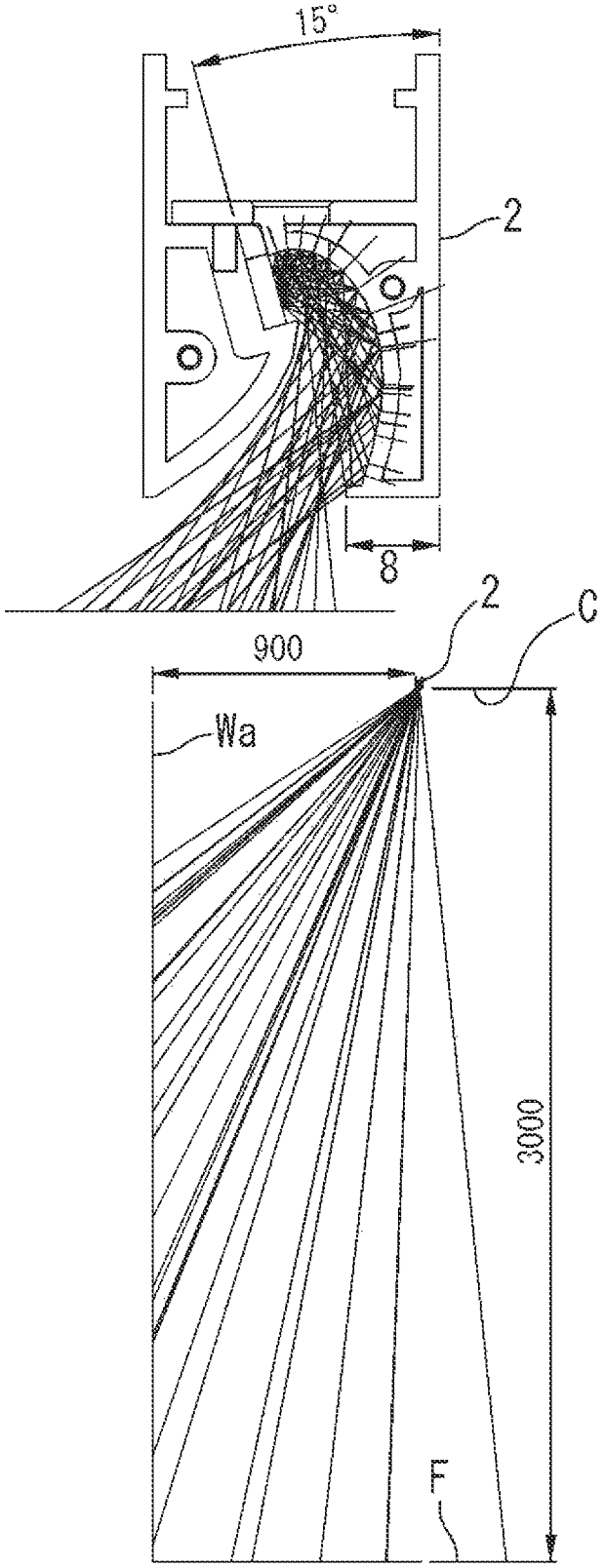
FIG. 6 is a light path diagram of the lighting unit body 2 illustrated in FIG. 3.

FIG. 6 illustrates light paths when the lighting unit body 2 illustrated in FIG. 3 is mounted onto a ceiling C with a height of 3000 mm from a floor surface F, and spaced 900 mm apart from a wall surface Wa.

As illustrated in FIG. 6, according to the lighting unit body 2, the illuminated area of the floor surface F is reduced compared with the case of the lighting unit body 1 illustrated in FIG. 5, but the illuminated area of the wall surface Wa is increased and the wall surface Wa ranging from the floor surface F to a portion upper than the middle of the wall surface Wa can be illuminated.

Note that the lighting unit body 2 of the second embodiment can provide all the effects and advantages of the lighting unit body 1 of the first embodiment.

Third Embodiment

The lighting unit body 3 according to the third embodiment, to which the present invention is applied, is described with reference to FIG. 4 and FIG. 7.

Figure 4:
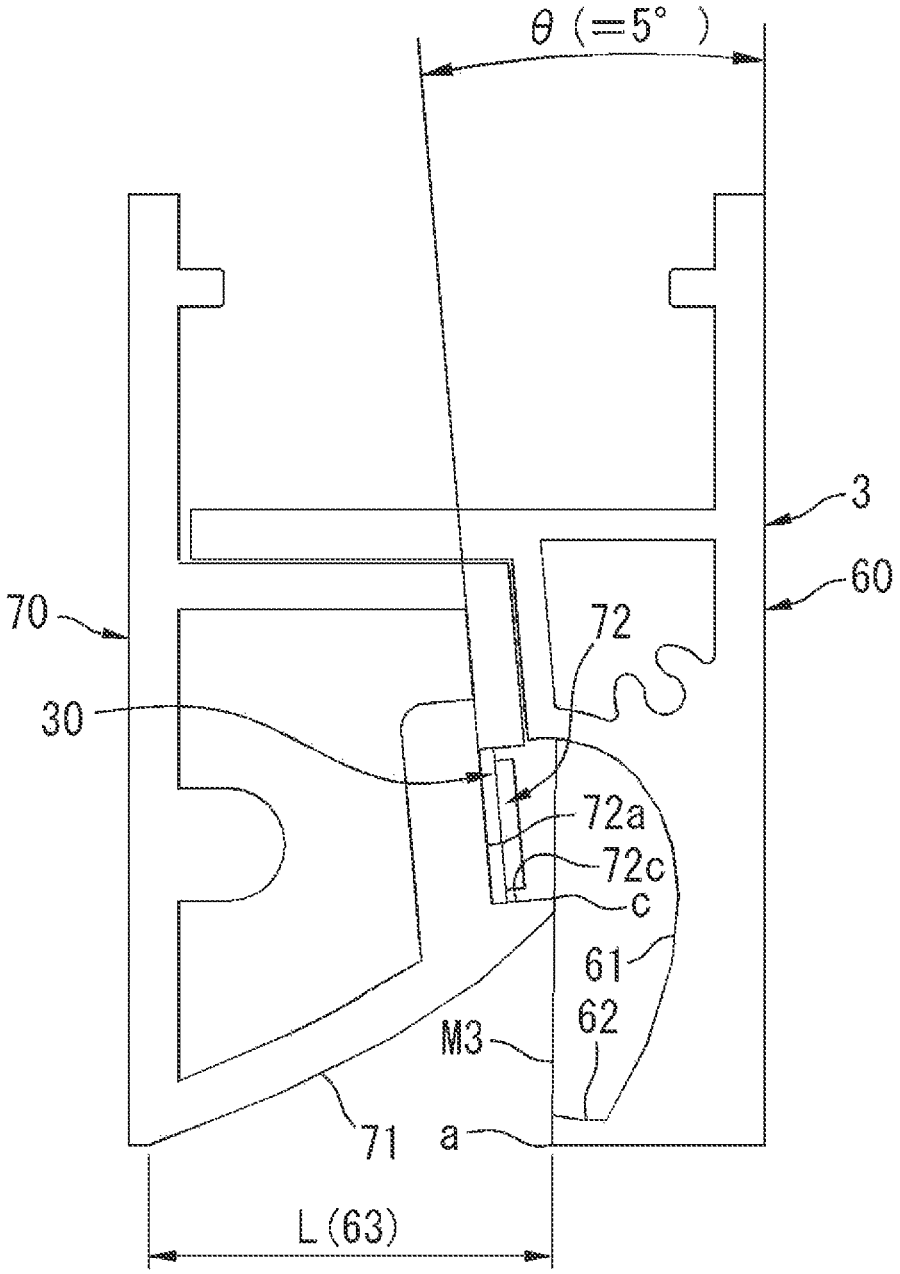
FIG. 4 is a schematic diagram illustrating a cross section orthogonal to a longitudinal direction of a lighting unit body 3 of a third embodiment.

FIG. 4 is a schematic diagram illustrating a cross section orthogonal to the longitudinal direction of the lighting unit body 3 of the third embodiment. FIG. 7 is a light path diagram of the lighting unit body 3 illustrated in FIG. 4.

Note that how the lighting unit body 3 is mounted onto a ceiling C or wall surface Wa is similar to those described for the lighting unit body 1 of the first embodiment. In addition, in the discussion below, differences between the lighting unit body 3 illustrated in FIG. 4 and the lighting unit body 1 illustrated in FIG. 2 are mainly described.

The lighting unit body 3 comprises shaped-members 60 and 70 and a light source 30, as illustrated in FIG. 4.

The shaped-member 60 has a concave first reflective surface 61, and a protrusion 62 is formed at an emission outlet 63.

The shaped-member 70 has a second reflective surface 71 and a housing portion 72. A predefined inclined angle θ of the housing portion 72 is equal to a predefined inclined angle θ of a bottom surface 72*a*, and set to be θ=5°. In other words, the predefined inclined angle θ was set to be θ=35° in the first embodiment, whereas θ=5° in the third embodiment. Based on this difference, the first reflective surface 61 and the second reflective surface 71 have shapes different from those in the first embodiment.

The light source 30 is the same as that of the lighting unit body 1, but it has a different predefined inclined angle θ.

Also in the third embodiment, the light source 30 is disposed nearer to a bottom surface 72*a* than a straight line M3 connecting a tip a of the protrusion 62 and a tip c of a front side surface 72*c*. Therefore, the light source 30 is not visible from the front of the emission outlet 63.

Figure 7:
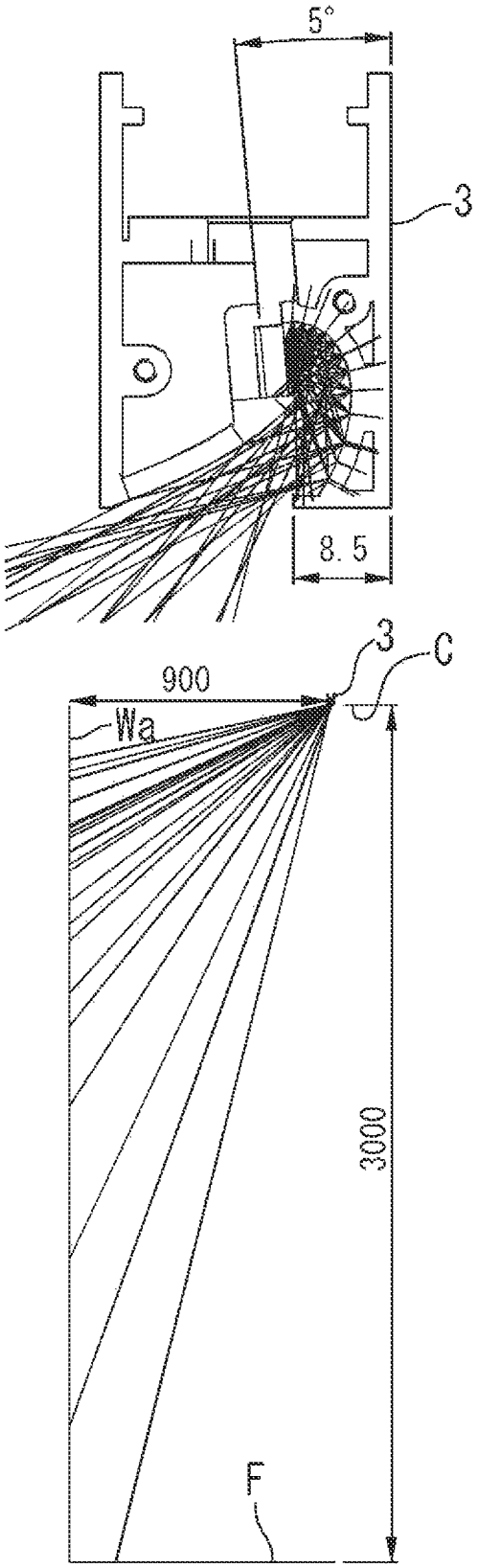
FIG. 7 is a light path diagram of the lighting unit body 3 illustrated in FIG. 4.

FIG. 7 illustrates light paths when the lighting unit body 3 illustrated in FIG. 4 is mounted onto a ceiling C with a height of 3000 mm from a floor surface F, and spaced 900 mm apart from a wall surface Wa.

As illustrated in FIG. 7, according to the lighting unit body 3, a much less portion of the floor surface F is illuminated compared with lighting unit body 1 illustrated in FIG. 5, and almost the entire wall surface Wa is illuminated.

Note that the lighting unit body 3 of the third embodiment can provide all the effects and advantages of the lighting unit body 1 of the first embodiment.

DESCRIPTION OF REFERENCE NUMERALS

1 Lighting unit body (First embodiment)
2 Lighting unit body (Second embodiment)
3 Lighting unit body (Third embodiment)
10, 20, 40, 50, 60, 70 Shaped-member
11, 41, 61 First reflective surface
12, 42, 62 Protrusion
13, 43, 63 Emission outlet
21, 51, 71 Second reflective surface
22, 52, 72 Housing portion
22*a*, 52*a*, 72*a* Bottom surface
22*b* Rear side surface
22*c*, 52*c*, 72*c* Front side surface
30 Light source
100 Lighting unit
a Tip of the protrusion
b Tip of the rear side surface
c Tip of the front side surface
L Left-to-right direction width of the emission outlet
θ Predefined inclined angle

The invention claimed is:

1. A lighting unit body, comprising:

a light source; and a shaped-member, in which a housing portion in which the light source is disposed, a reflective surface for reflecting light that comes from the light source, and an emission outlet for emitting the light that comes from the reflective surface are respectively formed in a longitudinal direction;

wherein, when a position at which the emission outlet is located is defined as forward and a direction orthogonal to the longitudinal direction is defined as a front-to-rear direction, and a direction orthogonal both to the longitudinal direction and the front-to-rear direction is defined as a left-to-right direction, then the emission outlet is formed in a front portion of the reflective surface, and the housing portion is formed in a rear portion of the reflective surface, directed obliquely rearward at a predefined inclined angle on one of either left or right side, wherein the predefined inclined angle is an angle that inhibits visual observation of the light source from the front of the emission outlet, and wherein a left-to-right direction position at which the light source is disposed is included in a left-to-right direction position at which the emission outlet is located, wherein the housing portion is formed into a concave shape, and comprises a bottom surface on which the light source is to be disposed and which is inclined at the predefined inclined angle, a rear side surface located rearward, and a front side surface located forward, the reflective surface comprises a first reflective surface being concave and extending from the vicinity of a tip of the rear side surface to an end of the emission outlet on the one of the either left or right side, and a second reflective surface being convex and extending from the vicinity of a tip of the front side surface to the other end of the emission outlet, and the first reflective surface and the second reflective surface face each other, with a spacing therebetween in the left-to-right direction being wider at a front portion than at a rear portion .

2. The lighting unit body according to claim 1, wherein, from the emission outlet, direct light that comes from the light source is not emitted, and only indirect light that comes from the light source and that is then reflected by the reflective surface is emitted.

3. The lighting unit body according to claim 1, wherein the predefined inclined angle θ is 5°≤θ≤45° with respect to the front-to-rear direction.

4. The lighting unit body according to claim 1, wherein a protrusion extending from the first reflective surface toward the second reflective surface is formed at the emission outlet, and a left-to-right direction width of the emission outlet is reduced by a height of the protrusion.

5. The lighting unit body according to claim 4, wherein the light source is disposed at a position nearer to the bottom surface than a straight line connecting a tip of the protrusion and a tip of the front side surface.

6. The lighting unit body according to claim 1, wherein the first reflective surface is formed of one component which is one of a plurality of components that make up the shaped-member, and the second reflective surface is formed of another one component.

* * * * *